US006813912B1

(12) United States Patent
Ng et al.

(10) Patent No.: US 6,813,912 B1
(45) Date of Patent: Nov. 9, 2004

(54) SECURE LOCKBOX

(75) Inventors: Kwan Yuen Abraham Ng, City of Industry, CA (US); Sarah Seen Yui Chan Ng, City of Industry, CA (US)

(73) Assignees: Loyal International Inc., City of Industry, CA (US); Link Worldwide Sourcing, City of Industry, CA (US)

( * ) Notice: Subject to any disclaimer, the term of this patent is extended or adjusted under 35 U.S.C. 154(b) by 0 days.

(21) Appl. No.: 10/757,736

(22) Filed: Jan. 14, 2004

(51) Int. Cl.[7] ..... E05B 37/00; E05B 65/52

(52) U.S. Cl. ..... 70/21; 70/63; 70/284; 70/285; 70/DIG. 63

(58) Field of Search ..... 70/21, 63, 38 B, 70/25, 284, 285, 423–428, 455, DIG. 44, DIG. 63, DIG. 71

(56) References Cited

U.S. PATENT DOCUMENTS

| | | | | | |
|---|---|---|---|---|---|
| 1,755,521 | A | * | 4/1930 | Smith | |
| 2,497,619 | A | * | 2/1950 | Mass | |
| 4,325,240 | A | * | 4/1982 | Gable | 70/284 |
| 4,462,231 | A | * | 7/1984 | Zabel | 70/21 |
| 4,532,783 | A | * | 8/1985 | Maurice | 70/63 |
| 4,649,723 | A | * | 3/1987 | Appelbaum | 70/63 |
| 4,727,368 | A | | 2/1988 | Larson et al. | 340/825.31 |
| 4,751,830 | A | * | 6/1988 | Cheng | 70/25 |
| 4,766,746 | A | | 8/1988 | Henderson et al. | 70/63 |
| 4,895,036 | A | * | 1/1990 | Larson et al. | 70/284 |
| 5,046,084 | A | | 9/1991 | Barrett et al. | 379/100 |
| 5,084,945 | A | | 2/1992 | Childers | 24/530 |
| 5,134,869 | A | * | 8/1992 | Gable | 70/63 |
| 5,245,652 | A | | 9/1993 | Larson et al. | 379/98 |
| 5,705,991 | A | | 1/1998 | Kniffin et al. | 340/825.31 |
| 5,815,557 | A | | 9/1998 | Larson | 379/102.06 |
| 6,539,761 | B2 | * | 4/2003 | Yang | 70/284 |
| 6,708,534 | B1 | * | 3/2004 | Ruan | 70/38 A |

* cited by examiner

*Primary Examiner*—Lloyd A. Gall
(74) *Attorney, Agent, or Firm*—David A. Belasco; Belasco Jacobs & Townsley, LLP

(57) ABSTRACT

A secure lockbox includes an interior key lock that controls access to the mechanism for setting and changing the combination for the lock controlling access to the interior storage compartment of the lockbox. A second key lock controls the attachment bail of the lockbox, preventing unauthorized removal of the lockbox. The two key locks may be identically keyed. In a variant of the invention, a second combination lock controls the attachment bail instead of a key lock. Resilient coverings are provided for the attachment bail and the sides of the lockbox body to prevent damage to buildings and fixtures. A chain is provided to secure the door of the lockbox to the body. A slide latch having non-slip features is controlled by the door's combination lock and engages an edge of the door opening to secure the door opening. The slide latch may have a protrusion for ease of use.

11 Claims, 2 Drawing Sheets

SECURE LOCKBOX

FIELD OF INVENTION

The invention lockboxes for use in real estate sales and related transactions. More particularly, the invention relates to lockboxes designed to prevent unintended changing of the lockbox combination.

BACKGROUND OF THE INVENTION

Lockboxes are commonly used in the real estate sales industry to provide means for a large number of salesmen to gain access to a locked building. The lockbox is secured to the building and contains a key fitting a lock controlling access to the building. The lockbox key repository is typically secured with a combination lock. The combination for this lock is usually distributed to the real estate community so as to provide limited access to the building. In most lockboxes, once the correct combination has been entered and the repository opened, the lockbox may be removed from the attachment to the building. Further, with the repository open, the combination may also be changed. This sometimes leads to problems. A dishonest agent could open the repository and then change the combination so that only he has access, shutting out other agents. Further, an agent could open the repository and then remove the lockbox altogether, again shutting out other agents.

A number of lockbox designs have been developed. U.S. Pat. No. 5,815,557 issued to Larson discloses a secure entry system that makes use of radio transmissions to communicate with locks, keys, and related components throughout the system. The radio transmissions can be made using a paging system, a cellular telephone system, or any other RF carrier. Some embodiments employ a cellular telephone in lieu of an electronic key. Others integrate a paging receiver within an electronic key to provide a unit with dual functionality. The system is illustrated with reference to exemplary applications in the industrial site security, real estate lockbox, and transportation fields. A homeowner key allows the homeowner greater oversight and involvement. The key includes a privacy feature, enabling the homeowner to disable the lockbox for a predetermined period if privacy is desired.

U.S. Pat. No. 5,705,991 issued to Kniffin, et al. describes a secure entry system that makes use of radio transmissions to communicate with locks, keys, and related components throughout the system. The radio transmissions can be made using a paging system, a cellular telephone system, or any other RF carrier. Some embodiments employ a cellular telephone in lieu of an electronic key. Others integrate a paging receiver within an electronic key to provide a unit with dual functionality. The system is illustrated with reference to exemplary applications in the industrial site security, real estate lockbox, and transportation fields.

U.S. Pat. No. 5,245,652 issued to Larson, et al. discloses a comprehensive real estate lockbox system which provides a variety of operational features. One of these includes a reader key that can retrieve access data from a system lockbox. The reader key is provided with an audible tone generator which can be selectively enabled by the user. The tone generator can be used to download data from the reader key over telephone lines.

U.S. Pat. No. 5,084,945 issued to Childers describes a detent clip adapted to fit around the edge of a door and positioned so that the clip prevents the swinging movement of a real estate lockbox attached to the handle of the door.

The clip comprises a substantially U-shaped member, one leg of which has a projecting portion to bear against the lockbox thereby deterring its swinging movement when the door is opened or closed.

U.S. Pat. No. 5,046,084 issued to Barrett, et al. describes an electronic real estate lockbox system that includes a facsimile reporting capability. More particularly, numeric data detailing the location of a lockbox, dates and times of accesses to the lockbox, and the identities of the keyholders who accessed the lockbox, is transferred from the lockbox to a central computer. The central computer interprets this numeric data to provide human-readable names, addresses, etc. After translation, the central computer formats the data for facsimile transmission to the local real estate offices that require the information to track usage of the lockbox.

U.S. Pat. No. 4,766,746 issued to Henderson, et al. discloses a comprehensive real estate lockbox system which provides a variety of operational features. Some of these features include the ability to: record all accesses to all lockboxes; transfer all or part of such records from the lockboxes to a supervising real estate agency or board; organize and review such records; facilitate operation of lockboxes that are mounted in awkward or poorly lit locations; limit lockbox accesses to preselected agents, agencies or boards; reprogram lockboxes in the field; monitor redundantly the status of the lockbox battery; record diagnostic information on each operation of a lockbox or key; render keys inoperative on predetermined dates; disable unauthorized keys; grant agents from remote real estate boards permission to open certain lockboxes, and; grant different keys different privileges.

U.S. Pat. No. 4,727,368 issued to Larson, et al. describes real estate lockbox and key designs which provide a variety of operational features. Also disclosed is a comprehensive system that allows real estate boards and agencies to efficiently manage their lockbox operations. Features provided by the system include the ability to record all accesses to all lockboxes; transfer all or part of such records from the lockboxes to the real estate agency or board; organize and review such records at the agency or board offices; disable operation of various lockboxes during certain hours of the day; facilitate operation of lockboxes that are mounted in awkward or poorly lit locations; limit lockbox accesses to preselected agents, agencies or boards; and record diagnostic information with each operation of a lockbox or key.

It is an objective of the present invention to provide a lockbox for use in the real estate sales industry that is secure from unauthorized removal. It is a further objective to provide a lockbox that has an interior key-retaining chamber that is secured by a combination lock. It is a still further objective of the invention to means to control access to the setting of the combination for the lockbox. It is a final objective to provide a lockbox that may be easily used, is rugged and reliable and that may be inexpensively manufactured and maintained.

While some of the objectives of the present invention are disclosed in the prior art, none of the inventions found include all of the requirements identified.

SUMMARY OF THE INVENTION

The present invention addresses all of the deficiencies of prior art weighing and counting inventions and satisfies all of the objectives described above.

(1) A secure lockbox providing the desired features may be constructed from the following components. A body is provided. The body has a top surface, a side surface, an attachment bail and an interior cavity, the interior cavity extends inwardly from an opening in the side surface. The attachment bail extends upwardly from the top surface of the body and is slidable from a first, open position to a second, closed position in which the lockbox is secured to a building fixture.

A first key lock is provided. The first key lock is located within the interior cavity and secures the bail in the second, closed position. A door is provided. The door is sized and shaped to be removably secured to the opening. A combination lock is provided. The combination lock is fitted to the door, controls access to the interior cavity through the opening, and has a combination that is changed through access to a rear panel of the door. A second key lock is provided. The second key lock controls access to the combination lock. When the attachment bail is in the first open position it is attached to the building fixture and slid into the second, closed position and then locked in the second, closed position with the first key lock. The combination of the combination lock is then set and secured with the second key lock. A building key is then inserted in the interior cavity and the door secured to the opening with the combination lock, thereby permitting access to a building to only those who have been given the combination and preventing changes to the combination and removal of the lockbox.

(2) In a variant of the invention, the body has a top surface, a side surface, an attachment bail and an interior cavity, the interior cavity extends inwardly from an opening in the side surface. The attachment bail extends upwardly from the top surface of the body and is slidable from a first, open position to a second, closed position in which the lockbox is secured to a building fixture. A first combination lock is provided. The first combination lock is located upon the top surface and secures the bail in the second, closed position. A door is provided. The door is sized and shaped to be removably secured to the opening. A second combination lock is provided. The second combination lock is fitted to the door, controls access to the interior cavity through the opening, and has a combination that is changed through access to a rear panel of the door. A key lock is provided. The key lock controls access to the second combination lock. When the attachment bail is in the first open position it is attached to the building fixture and slid into the second, closed position and then locked in the second, closed position with the first combination lock. The combination of the second combination lock is then set and secured with the key lock. A building key is then inserted in the interior cavity and the door secured to the opening with the second combination lock, thereby permitting access to a building to only those who have been given the combination and preventing changes to the combination and removal of the lockbox.

(3) In yet another variant, a resilient covering for the body is provided. The covering is located over the side surfaces of the body to prevent damage to buildings.

(4) In still another variant, a resilient sleeve for the attachment bail is provided. The sleeve prevents damage to building fixtures.

(5) In a further variant, the first key lock and the second key lock are identically keyed.

(6) In still a further variant, a weatherproof cover is provided. The weatherproof cover is removably secured over the first combination lock.

(7) In another variant of the invention, a chain is provided. The chain attaches the door to the body.

(8) In still another variant, a protruding ledge is provided. The protruding ledge extends outwardly from an edge of the door and is sized and shaped to fit pivotally into an edge of the opening. A sliding latch is provided. The sliding latch is sized, shaped and disposed to removably engage an edge of the opening, and is slidable from a first, disengaged position to a second engaged position for securing the door to the opening. The latch is releasably locked in the engaged position by the combination lock.

(9) In yet another variation, a protruding ledge is provided. The protruding ledge extends from an edge of the door and is sized and shaped to fit pivotally into an edge of the opening. A sliding latch is provided. The sliding latch is sized, shaped and disposed to removably engage an edge of the opening, and is slidable from a first, disengaged position to a second engaged position for securing the door to the opening. The latch is releasably locked in the engaged position by the second combination lock.

(10) In a further variant, the sliding latch includes a non-slip surface.

(11) In a final variant of the invention, the sliding latch includes a protrusion extending outwardly from the door.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1–2 illustrate a secure lockbox 10 providing the desired features that may be constructed from the following components. A body 15 is provided. The body 15 has a top surface 20, a side surface 25, an attachment bail 30 and an interior cavity 35, the interior cavity 35 extends inwardly from an opening 40 in the side surface 25. The attachment bail 30 extends upwardly from the top surface 20 of the body 15 and is slidable from a first, open position 45 to a second, closed position 50 in which the lockbox 10 is secured to a building fixture (not shown).

Figure 1:
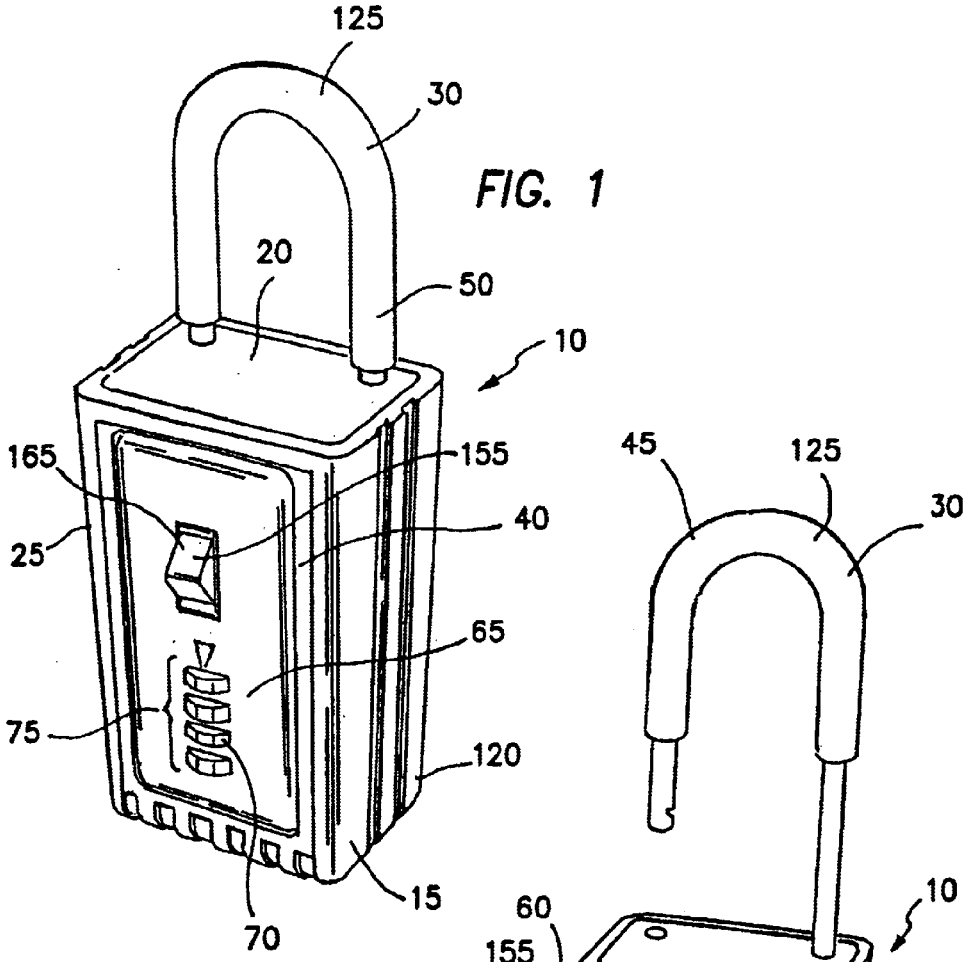
FIG. 1 is a perspective view of a first embodiment of the invention including a key operated lock for securing the attachment bail.

A first key lock 60 is provided. The first key lock 60 is located within the interior cavity 35 and secures the bail 30 in the second, closed position 50. A door 65 is provided. The door 65 is sized and shaped to be removably secured to the opening 40. A combination lock 70 is provided. The combination lock 70 is fitted to the door 65, controls access to the interior cavity 35 through the opening 40, and has a combination 75 that is changed through access to a rear panel 80 of the door 65. A second key lock 85 is provided. The second key lock 85 controls access to the combination lock 70. When the attachment bail 30 is in the first open position 45 it is attached to the building fixture and slid into the second, closed position 50 and then locked in the second, closed position 50 with the first key lock 60. The combination 75 of the combination lock 70 is then set and secured with the second key lock 85. A building key 90 is then inserted in the interior cavity 35 and the door 65 secured to the opening 40 with the combination lock 70, thereby permitting access to a building (not shown) to only those who have been given the combination 75 and preventing changes to the combination 75 and removal of the lockbox 10.

Figure 3:
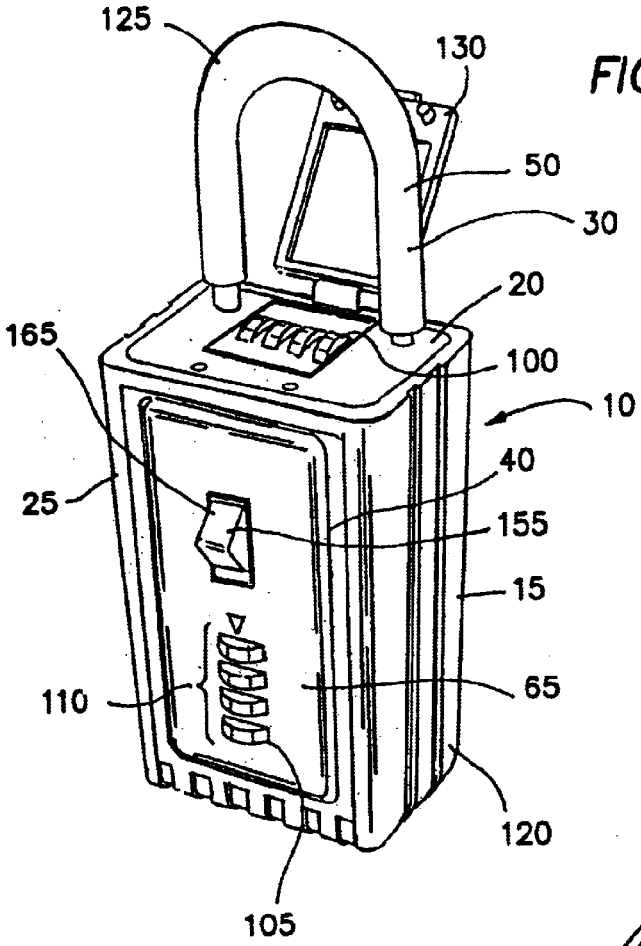
FIG. 3 a perspective view of a second embodiment of the invention including a combination lock for securing the attachment bail.
Figure 4:
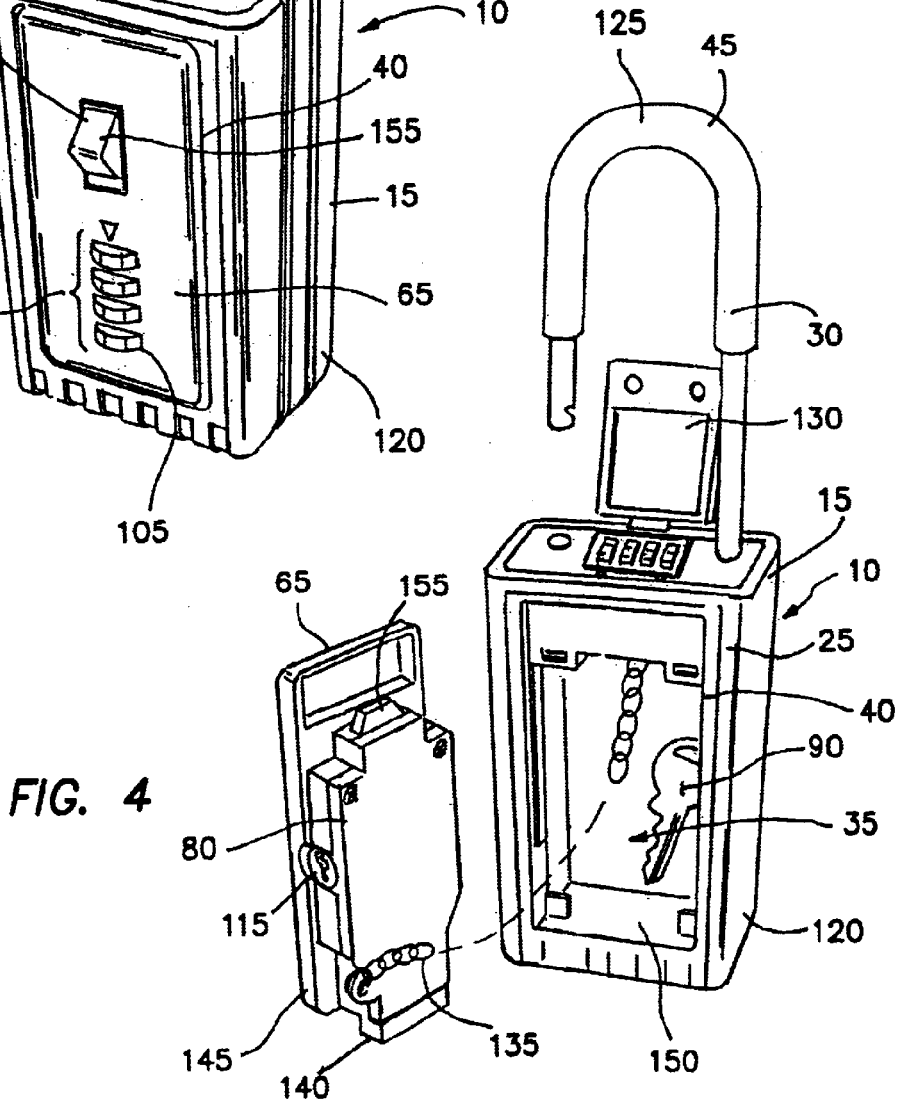
FIG. 4 is a perspective view of the FIG. 3 embodiment illustrating the lockbox door in the open position and attachment chain.

(2) In a variant of the invention, as illustrated in FIGS. 3 and 4, the body 15 has a top surface 20, a side surface 25, an attachment bail 30 and an interior cavity 35, the interior cavity 35 extends inwardly from an opening 40 in the side surface 25. The attachment bail 30 extends upwardly from the top surface 20 of the body 15 and is slidable from a first, open position 45 to a second, closed position 50 in which the lockbox 10 is secured to a building fixture.

A first combination lock 100 is provided. The first combination lock 100 is located upon the top surface 20 and secures the bail 30 in the second, closed position 50. A door 65 is provided. The door 65 is sized and shaped to be removably secured to the opening 40. A second combination lock 105 is provided. The second combination lock 105 is fitted to the door 65, controls access to the interior cavity 35 through the opening 40, and has a combination 110 that is changed through access to a rear panel 80 of the door 65. A key lock 115 is provided. The key lock 115 controls access to the second combination lock 105. When the attachment bail 30 is in the first open position 45 it is attached to the building fixture and slid into the second, closed position 50 and then locked in the second, closed position 50 with the first combination lock 100. The combination 110 of the second combination lock 105 is then set and secured with the key lock 115. A building key 90 is then inserted in the interior cavity 35 and the door 65 secured to the opening 40 with the second combination lock 105, thereby permitting access to a building to only those who have been given the combination 110 and preventing changes to the combination 110 and removal of the lockbox 10.

(3) In yet another variant, as illustrated in FIGS. 1–4, a resilient covering 120 for the body 15 is provided. The covering 120 is located the side surfaces 25 of the body 15 to prevent damage to buildings.

(4) In still another variant, a resilient sleeve 125 for the attachment bail 30 is provided. The sleeve 125 prevents damage to building fixtures.

(5) In a further variant, the first key lock 60 and the second key lock 85 are identically keyed.

(6) In still a further variant, as illustrated in FIGS. 3 and 4, a weatherproof cover 130 is provided. The weatherproof cover 130 is removably secured over the first combination lock 100.

Figure 2:
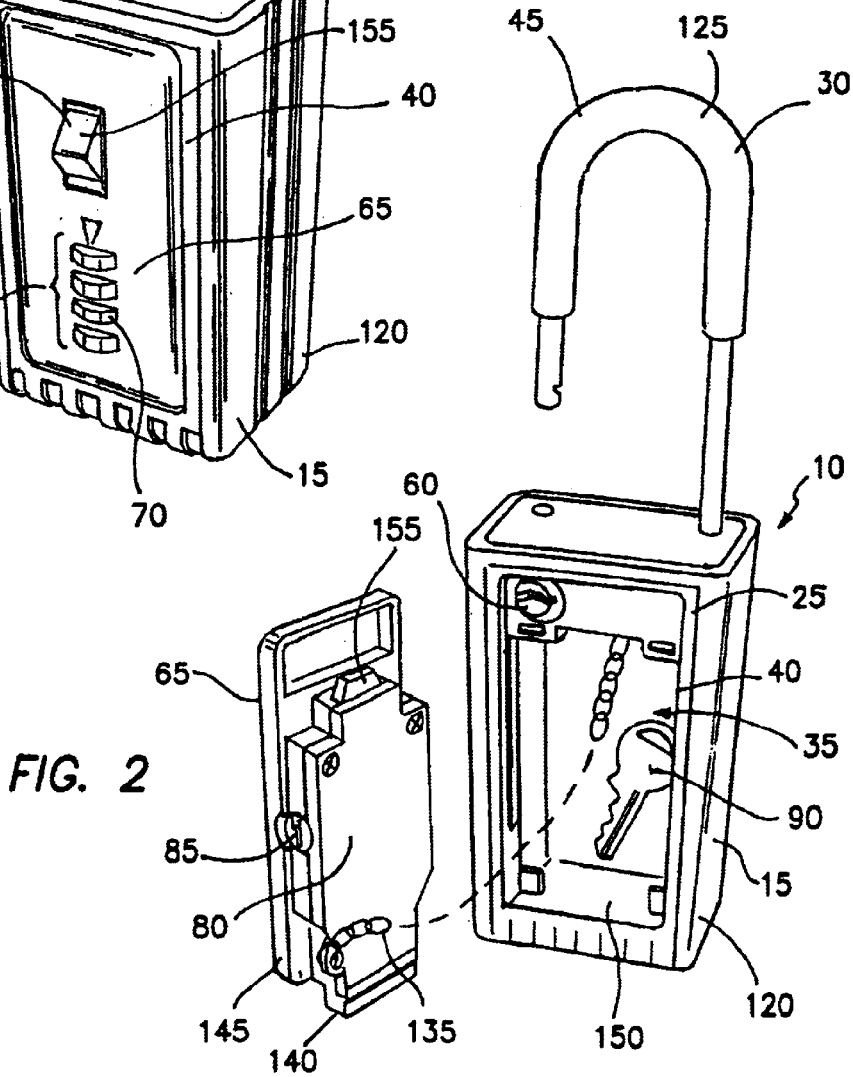
FIG. 2 is a perspective view of the FIG. 1 embodiment illustrating the lockbox door in the open position and attachment chain.

(7) In another variant of the invention, as illustrated in FIGS. 2 and 4, a chain 135 is provided. The chain 135 attaches the door 65 to the body 15.

(8) In still another variant, as illustrated in FIGS. 1 and 2, a protruding ledge 140 is provided. The protruding ledge 140 extends outwardly from an edge 145 of the door 65 and is sized and shaped to fit pivotally into an edge 150 of the opening 40. A sliding latch 155 is provided. The sliding latch 155 is sized, shaped and disposed to removably engage an edge 150 of the opening 40, and is slidable from a first, disengaged position to a second engaged position for securing the door 65 to the opening 40. The latch 155 is releasably locked in the engaged position by the combination lock 70.

(9) In yet another variation, as illustrated in FIGS. 3 and 4, a protruding ledge 140 is provided. The protruding ledge 140 extends from an edge 145 of the door 65 and is sized and shaped to fit pivotally into an edge 150 of the opening 40. A sliding latch 155 is provided. The sliding latch 155 is sized, shaped and disposed to removably engage an edge 150 of the opening 40, and is slidable from a first, disengaged position to a second engaged position for securing the door 65 to the opening 40. The latch 155 is releasably locked in the engaged position by the second combination lock 105.

(10) In a further variant, as illustrated in FIGS. 1 and 3, the sliding latch 155 includes a non-slip surface.

(11) In a final variant of the invention, the sliding latch 155 includes a protrusion 165 extending outwardly from the door 65.

The secure lockbox 10 has been described with reference to particular embodiments. Other modifications and enhancements can be made without departing from the spirit and scope of the claims that follow.

What is claimed is:

1. A secure lockbox, comprising:

a body, said body having a top surface, a side surface, an attachment bail and an interior cavity, said interior cavity extending inwardly from an opening in said side surface;

said attachment bail extending upwardly from said top surface of said body and being slidable from a first, open position to a second, closed position in which said lockbox is secured to a building fixture;

a first key lock, said first key lock being disposed within said interior cavity and securing said bail in said second, closed position;

a door, said door being sized and shaped to be removably secured to said opening;

a combination lock, said combination lock being fitted to said door, controlling access to said interior cavity through said opening, and having a combination that is changed through access to a rear panel of said door;

a second key lock, said second key lock controlling access to said combination lock; and whereby, when said attachment bail is in said first open position it is attached to said building fixture and slid into said second, closed position and then locked in said second, closed position with said first key lock, said combination of said combination lock is then set and secured with said second key lock, a building key is then inserted in said interior cavity and said door secured to said opening with said combination lock, thereby permitting access to a building to only those who have been given said combination and preventing changes to said combination and removal of said lockbox.

2. A secure lockbox, comprising:

a body, said body having a top surface, a side surface, an attachment bail and an interior cavity, said interior cavity extending inwardly from an opening in said side surface;

said attachment bail extending upwardly from said top surface of said body and being slidable from a first, open position to a second, closed position in which said lockbox is secured to a building fixture;

a first combination lock, said first combination lock being disposed upon said top surface and securing said bail in said second, closed position;

a door, said door being sized and shaped to be removably secured to said opening;

a second combination lock, said second combination lock being fitted to said door, controlling access to said interior cavity through said opening, and having a combination that is changed through access to a rear panel of said door;

a key lock, said key lock controlling access to said second combination lock; and whereby, when said attachment bail is in said first open position it is attached to said building fixture and slid into said second, closed position and then locked in said second, closed position with said first combination lock, said combination of said second combination lock is then set and secured with said key lock, a building key is then inserted in said interior cavity and said door secured to said opening with said second combination lock, thereby permitting access to a building to only those who have been given said combination and preventing changes to said combination and removal of said lockbox.

3. The secure lockbox as described in claim 1 or claim 2, further comprising a resilient covering for said body, said covering being disposed over side surfaces of said body to prevent damage to buildings.

4. The secure lockbox as described in claim 1 or claim 2, further comprising a resilient sleeve for said attachment bail, said sleeve preventing damage to building fixtures.

5. The secure lockbox as described in claim 1, wherein said first key lock and said second key lock are identically keyed.

6. The secure lockbox as described in claim 2, further comprising a weatherproof cover, said weatherproof cover being removably secured over said first combination lock.

7. The secure lockbox as described in claim 1 or claim 2, further comprising a chain, said chain attaching said door to said body.

8. The secure lockbox as described in claim 1, further comprising:

a protruding ledge, said protruding ledge extending outwardly from an edge of said door and being sized and shaped to fit pivotally into an edge of said opening;

a sliding latch, said sliding latch being sized, shaped and disposed to removably engage an edge of said opening, and being slidable from a first, disengaged position to a second engaged position for securing said door to said opening;

said latch being releasably locked in said engaged position by said combination lock.

9. The secure lockbox as described in claim 2, further comprising:

a protruding ledge, said protruding ledge extending from an edge of said door and being sized and shaped to fit pivotally into an edge of said opening;

a sliding latch, said sliding latch being sized, shaped and disposed to removably engage an edge of said opening, and being slidable from a first, disengaged position to a second engaged position for securing said door to said opening;

said latch being releasably locked in said engaged position by said second combination lock.

10. The secure lockbox as described in claim 8 or claim 9, wherein said sliding latch comprises a non-slip surface.

11. The secure lockbox as described in claim 8 or claim 9, wherein said sliding latch comprises a protrusion extending outwardly from said door.

* * * * *